United States Patent [19]

Parazak et al.

[11] Patent Number: 4,918,959

[45] Date of Patent: Apr. 24, 1990

[54] METHOD FOR PREVENTING THE BUILDUP OF OILY DEPOSITS ON ROLLING MILL SCALE

[75] Inventors: Dennis P. Parazak, St. Louis; Charles W. Burkhardt, Fenton, both of Mo.; Rainer Langwald, Oberhausen, Fed. Rep. of Germany

[73] Assignee: Petrolite Corporation, St. Louis, Mo.

[21] Appl. No.: 306,601

[22] Filed: Feb. 6, 1989

[51] Int. Cl.[5] ..... B21B 45/06; B21B 45/08

[52] U.S. Cl. ..... 72/39

[58] Field of Search ..... 29/81 B; 72/39, 40; 134/10, 15

[56] References Cited

U.S. PATENT DOCUMENTS

| | | | |
|---|---|---|---|
| 3,345,841 | 10/1967 | Phelan et al. | 72/39 |
| 4,344,308 | 8/1982 | Shimada et al. | 72/39 |
| 4,475,369 | 10/1984 | Matsuda et al. | 72/39 X |

FOREIGN PATENT DOCUMENTS

| | | | |
|---|---|---|---|
| 56-126019 | 10/1981 | Japan | 72/39 |
| 58-126992 | 7/1983 | Japan | 72/39 |
| 59-23887 | 2/1984 | Japan | 72/39 |

*Primary Examiner*—E. Michael Combs

*Attorney, Agent, or Firm*—Stanley M. Tarter

[57] ABSTRACT

The formation of mill scale contaminated with an appreciable amount of oily substances is prevented by spraying rolled steel with an aqueous stream under high pressure containing an effective amount of a surfactant.

8 Claims, 1 Drawing Sheet

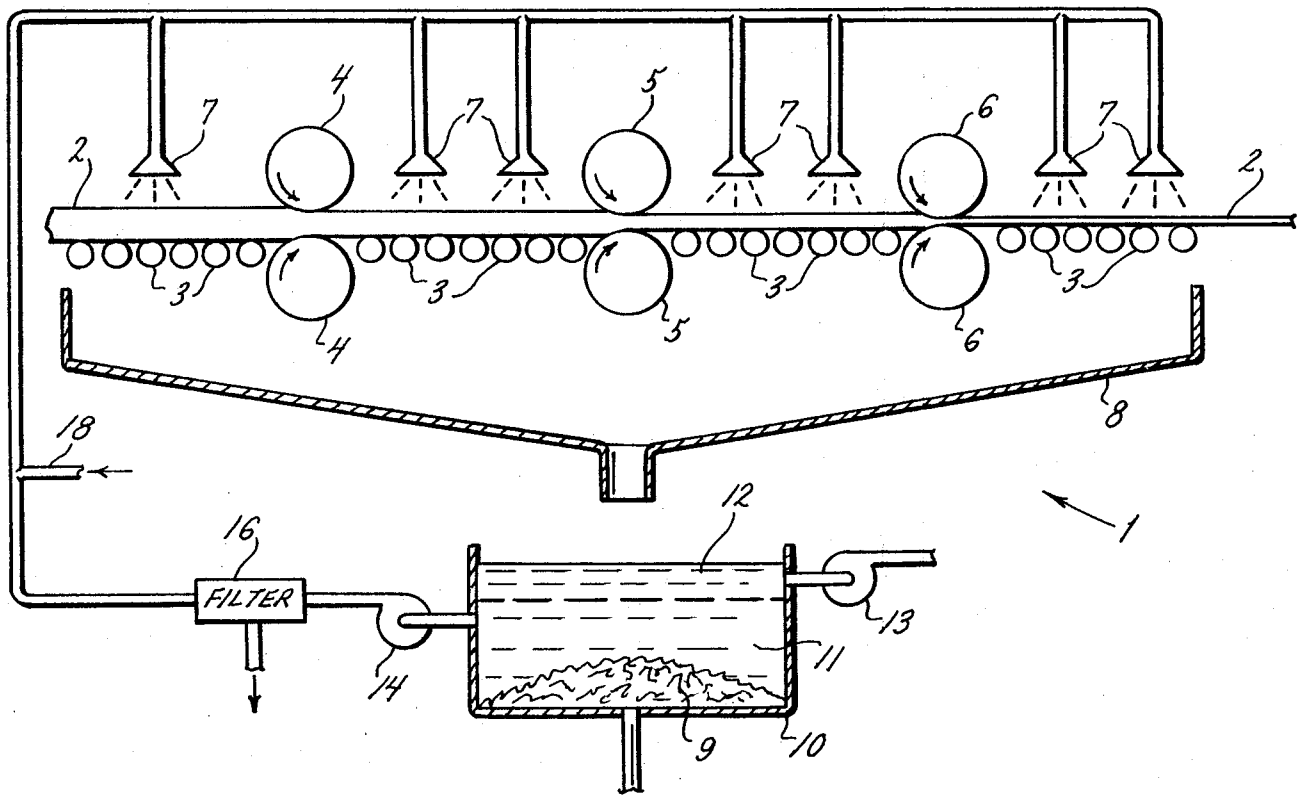
FILTER

METHOD FOR PREVENTING THE BUILDUP OF OILY DEPOSITS ON ROLLING MILL SCALE

FIELD OF THE INVENTION

1. Field of the Invention

The present invention relates to a chemical method for minimizing the buildup of oily deposits on rolling mill scale. More particularly, the present invention relates to a chemical method employing an aqueous stream for removing mill scale during a hot steel rolling operation while preventing or minimizing the buildup of oily deposits on such scale.

2. Prior Art

The presence of oxides (scale) on the surface of shaped steel bodies is known to be objectionable when the shaped steel body is further processed. The scale must be removed and clean surfaces provided if satisfactory results are to be obtained from the hot-rolled sheet or strip in any operation involving subsequent deformation of the shaped steel body. If the steel is produced for drawing applications, removal of the scale is of considerable importance in that the presence on the steel surface of scale shortens die life, causes irregular drawing conditions and destroys surface smoothness of the finished product. Scale removal is also necessary if the shaped sheet is to be used for further processing involving coating in order to permit proper alloying or adherence of metallic coating or if paint is applied to the sheet. In the production of cold-reduced steel sheets and strips, it is most important that the oxides resulting during hot drawing of the steel body be removed completely before cold reduction in order to prevent lack of uniformity and to eliminate surface irregularities.

The term "scale", as used herein, refers generally to the chemical compounds of iron and oxygen formed on the surfaces of the steel by exposure to air while the steel is at elevated temperatures. Hence, the oxides produced on steel surfaces during hot-rolling steel mill operations are known as "mill scale". In the most part, mill scale is composed of iron oxides.

Conversion of a steel casting into a rolled steel product is normally carried out in a series of thermal and mechanical operations. One such mechanical operation includes the application of heavy rolling pressure. The apparatus used in the rolling operations requires lubrication at all points where a bearing surface slides upon or rubs against another surface. Instead of using the lubricants in a closed system, it is conventional in the steel industry to apply the lubricant using an opened oil system because of the large and complex structure of a steel rolling facility. Thus, not only does the rolled steel have scale, but oily particles normally age deposited on the scale. The result is the formation of oily mill scale.

In rolling mills, especially hot rolling mills, vast quantities of rolling mill scale contaminated with grease or oil age obtained as an undesired by-product. For economical reasons the steel values in the scale should be recovered and reused. If the oily substances have not been removed from the scale, considerable difficulties are encountered in recovering the iron from the scale. Recovery of the iron from the scale often involves sintering of the scale; and the grease content in the scale may amount up to 5–6% by weight. When oily mill scale is sintered, considerable ecological problems arise, especially with regard to the purification of the waste water and the pollution of the air. In addition to the water and air contamination problems, removing oil or grease from mill scale by combustion is expensive, since the oil or grease content of the scale is insufficient to maintain the combustion.

The present invention provides a method by which buildup of oil on the surfaces of mill scale is hindered or prevented such that the scale can be sintered without the ecological problems arising as above described.

SUMMARY OF THE INVENTION

In accordance with the present invention, steel, being hot rolled using lubricated heavy rolls and lubricated carrier rolls such that mill scale is formed and the lubricant contaminates the scale, is sprayed with an aqueous stream containing about 2 ppm to 5,000 ppm surfactant, preferably about 10 ppm to 500 ppm surfactant. The lubricant is prevented from building up on the scale and becomes associated with the aqueous spray instead of being deposited on the surfaces of the mill scale.

Thus, the present invention provides a method by means of which the rolling mill scale which is obtained in rolling mills, especially hot rolling mills, is prevented from being deposited thereon. The iron content of the mill scale can be conveniently reclaimed without creating considerable ecological problems.

DETAILED DESCRIPTION OF THE INVENTION

Steel is hot rolled in a continuous manner by being passed between successive heavy rolls that shape the steel into a thinner more elongated body. As the steel is rolled, scale is normally formed on the surface of the resulting shaped body. Between at least one of the heavy rolls, an aqueous spray under significant pressure such as 10,000 psi (69 Mpa) or higher is impinged against the rolling shape body to flake off the scale. The aqueous spray contains an effective amount of a surfactant sufficient to emulsify oily substances emitted by the rolling mill equipment and deposited on the rolling shaped object The spray composition and the flaked off mill scale age conveyed together to a settling tank or scale pit. In the tank, the spray composition separates into an aqueous layer and an organic layer which is purged from the tank. Thereafter, the reclaimed aqueous phase is recycled for reuse in the rolling operation and the reclaimed organic phase is collected for further use or disposal.

BRIEF DESCRIPTION OF THE DRAWING

The accompanying drawing is a diagrammatic illustration of the practice of the present invention.

DESCRIPTION OF THE PREFERRED EMBODIMENT

With reference now to the drawing, numeral 1 generally denotes a conventional hot steel rolling mill. A steel body 2 is moved over a series of idle carrier rollers 3 into the nip of a first pair of driven counter rotatably mounted heavy rolls 4 that shape the body into a thinner, more elongated body. From the first pair of rolls 4 the shaped body is moved successively through rolls 5 and rolls 6. Although only three (3) sets of heavy rolls are illustrated, additional sets of heavy rolls may be employed depending to what extent the steel body needs to be attenuated.

As the steel body 2 is conveyed along the path in the rolling mills, pressurized aqueous solution impinges against the steel body with great force from a plurality of spray heads 7. The force is sufficient to erode or flake off scale formed on the surface of the body during the rolling operation. Oily substances which may be emitted from the bearings of the carrier rolls and driven rolls onto the surfaces of the steel body are prevented from building up on the scale and being absorbed thereby and are washed away. The spray liquid, together with the mill scale and other substances, gravitates into a container basin 8 and are funnelled into a settling tank 10. In the tank, the mill scale 9 settles to the bottom and the liquid floats to the top. The liquid separates into an aqueous layer 11 and an organic layer 12. The organic layer which contains the oily substances is skimmed from the top of the tank 10 and is removed therefrom by pump to a collection point not shown. Chemical or mechanical demuisifier may be used to provide for the separation of layers. The collected oily substances can be used or suitably discarded. Preferably, the aqueous layer is recycled by means of pump 13 via line 14 to spray heads 7. An in-line filter 16 may be provided to restrain any solids from clogging the spray heads. As desired, additional surfactant-containing aqueous solution is added to the system via line 18.

Although conventional surfactants can be used herein, it is preferred that surfactants of the nonionic type be used. Of the nonionic surfactants, nonylphenol condensed with about 3–50 moles of ethylene oxide is most preferred.

Nonionic organic surfactants useful in the present invention are known materials. Such nonionic surfactants may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a compound having the desired degree of balance between hydrophilic and hydrophobic moieties.

For example, a well known class of nonlonic organic surfactants is formed by condensing ethylene oxide, propylene oxide or mixtures thereof, with a hydrophobic base compound. The hydrophobic portion of the resulting condensate exhibits water insolubility. The addition of polyoxyalkylene radicals to the hydrophobic portion tends to increase the water solubility of the molecule as a whole.

Other suitable nonionic synthetic surfactants include:

1. The polyethylene oxide condensates of alkyl phenols, e.g., the condensation products of alkyl phenols having an alkyl group containing from about 4 to 12 carbon atoms in either a straight chain or branched chain configuration, with ethylene oxide, the said ethylene oxide being present in amounts equal to three to 50 moles of ethylene oxide per mole of alkyl phenol. The alkyl substituent in such compounds may be derived from polymerized propylene, diisobutylene, octene, or nonene, for example.

2. Those surfactants derived from the condensation of ethylene oxide with the product resulting from the reaction of propylene oxide and ethylene diamine. For example, compounds containing from about 40% to about 80% polyoxyethylene by weight and having a molecular weight of from about 5,000 to about 11,000 resulting from the reaction of ethylene oxide groups with a hydrophobic base constituted of the reaction product of ethylene diamine and excess propylene oxide. Bases having a molecular weight of the order of 2,500 to 3,000, are satisfactory.

3. The condensation product of aliphatic alcohols having from eight to 22 carbon atoms in either straight chain or branched chain configuration, with ethylene oxide, e.g., a coconut alcohol-ethylene oxide condensate having from 5 to 30 moles of ethylene oxide pet mole of coconut alcohol, the coconut alcohol fraction having from about 10 to 14 carbon atoms.

4. Nonionic surfactants include the condensation products of coconut alcohol with an average of about 5 to 15 moles of ethylene oxide per mole of alcohol and the condensation product of about 15 moles of ethylene oxide with one mole of tridecanol.

Other examples include dodecylphenol condensed with 12 moles of ethylene oxide per mole of phenol; dinonylphenol condensed with 15 moles of ethylene oxide per mole of phenol; dodecyl mercaptan condensed with 10 moles of ethylene oxide per mole of mercaptan; bis-(N-2-hydroxyethyl) lauramide; nonylphenol condensed with 20 moles of ethylene oxide per mole of nonylphenol; myristyl alcohol condensed with 10 moles of ethylene oxide per mole of myristyl alcohol; lauramide condensed with 15 moles of ethylene oxide per mole of lauramide; and di-iso-octylphenol condensed with 15 moles of ethylene oxide.

5. A surfactant having a formula $R_1R_2R_3N \rightarrow O$ (amine oxide detergent) wherein $R_1$ is an alkyl group containing from about 10 to about 28 carbon atoms, from 0 to about 2 hydroxy groups and from 0 to about 5 ether linkages, there being at least one moiety in $R_1$ which is an alkyl group containing from about 10 to about 18 carbon atoms and zero ether linkages, and each $R_2$ and $R_3$ are selected from the group consisting of alkyl radicals and hydroxyalkyl radicals containing from one to about three carbon atoms.

Specific examples of amine oxide surfactants include: dimethyldodecylamine oxide; dimethyltetradecylamine oxide; ethylmethyltetradecylamine oxide; cetyldimethylamine oxide; dimethylstearylamine oxide; cetylethylpropylamine oxide; diethyldodecylamine oxide; diethyltetradecylamine oxide; dipropyldodecylamine oxide; bis-(2-hydroxyethyl)dodecylamine oxide; bis-(2-hydroxyethyl)-3-dodecoxy-2-hydroxypropyl amine oxide; (2-hydroxypropyl) methyltetradecylamine oxide; dimethyloleyamine oxide; dimethyl-(2-hydroxydodecyl)amine oxide; and the corresponding decyl, hexadecyl and octadecyl homologs of the above compounds.

6. A surfactant having the formula $R_1R_2R_3P \rightarrow O$ (phosphine oxide surfactant) wherein $R_1$ is an alkyl group containing from about 10 to about 28 carbon atoms, from zero to about two hydroxy groups and from zero to about five ether linkages, there being at least one moiety of $R_1$ which is an alkyl group containing from about 10 to about 18 carbon atoms and zero ether linkages, and each of $R_2$ and $R_3$ are selected from the group consisting of alkyl radicals and hydroxyalkyl radicals containing from 1 to about 3 carbon atoms.

Specific examples of the phosphine oxide surfactants include: dimethyldodecylphosphine oxide; dimethyltetradecylamine oxide; ethylmethyltetradecylamine oxide; cetyldimethylamine oxide; dimethylstearylamine oxide; cetylethylpropylamine oxide; diethyldodecylamine oxide; diethyltetradecylamine oxide; dipropyldodecylamine oxide; bis-(2-hydroxyethyl)dodecylamine oxide; bis-(2-hydroxyethyl)-3-dodecoxy-1-hydroxypropyl amine oxide; (2-hydroxypropyl) methyltetradecylamine oxide; dimethyloleyamine oxide; dimethyl-(2-hydroxydodecyl)amine oxide; and the corresponding decyl, hexadecyl and octadecyl homologs of the above compounds.

7. A surfactant having the formula:

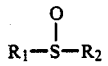

(sulfoxide detergent) where $R_1$ is an alkyl radical containing from about 10 to about 28 carbon atoms, from zero to about five ether linkages and from zero to about two hydroxyl substituents at least one moiety of $R_1$ being an alkyl radical containing zero ether linkages and containing from about 10 to about 18 carbon atoms, and wherein $R_2$ is an alkyl radical containing from 1 to 3 carbon atoms and from 1 to 2 hydroxyl groups: octadecylmethyl sulfoxide; dodecylmethyl sulfoxide; tetradecylmethyl sulfoxide; 2-hydroxytridecyl methyl sulfoxide; 3-methoxytridecyl methyl sulfoxide; 3-hydroxy-4-dodecoxybutyl methyl sulfoxide; octadecy 2-hydroxyethyl sulfoxide; dodecylethyl sulfoxide.

Cationic surfactants useful herein are known materials. Included are the di(higher) $C_{14}$–$C_{24}$ alkyl di(lower) $C_1$–$C_4$ alkyl quaternary ammonium salts with water solubilizing anions such as halide, (e.g., chloride, bromide and iodide), sulfate, methosulfate and the like and the cationic heterocyclics such as the imidazolinium compounds.

For convenience, the aliphatic quaternary ammonium salts may be structurally defined as follows:

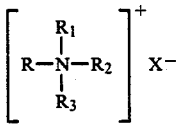

wherein R and $R_1$ represent alkyl, at least one of which is preferably 14 to 22 carbon atoms; $R_2$ and $R_3$ represent lower alkyl of one to four and preferably one to three carbon atoms, X represents an anion capable of imparting water solubility or dispersibility including the aforementioned chloride, bromide, iodide, sulfate and methosulfate. Particularly preferred species of aliphatic quaternaries include: distearyl dimethylammonium chloride; di-hydrogenated tallow dimethyl ammonium chloride; di-tallow dimethyl ammonium chloride; distearyl dimethyl ammonium methyl sulfate; dihydrogenated tallow dimethyl ammonium methyl sulfate.

Anionic surfactants for use herein generally include the water soluble salts of organic reaction products having in their molecular structure an anionic solubilizing group such $SO_4H$, $SO_3H$, COOH and an alkyl, alkyl or alkylaryl group having about 2 to 22 carbons in the alkyl group or moiety. Suitable detergents are anionic detergent salts having alkyl substituents of 8 to 22 carbon atoms such as: water soluble sulfated and sulfonated anionic alkali metal and alkaline earth metal detergent salts containing a hydrophobic higher alkyl moiety, such as salts of higher alkyl mono-or poly- nuclear aryl sulfonates having from about 8 to 18 carbon atoms in the alkyl group which may have a straight preferred or branched chain structure, preferred species including sodium linear tridecylbengene sulfonate, sodium linear dodecyl benzene sulfonate, sodium linear decyl benzene sulfonate, lithium or potassium pentapropylene benzene sulfonate; alkali metal salts of sulfated condensation of products of ethylene oxide, e.g., containing 3 to 20 and preferably 3 to 10 moles of ethylene oxide, with aliphatic alcohols containing 8 to 18 carbon atoms or with alkyl phenols having alkyl groups containing 6 to 18 carbon atoms, e.g., sodium nonylphenol pentaethoxamer sulfate and sodium lauryl alcohol triethoxamer sulfate; alkali metal salts of saturated alcohols containing from about 8 to 18 carbon atoms, e.g., sodium lauryl sulfate and sodium stearyl sulfate; alkali metal salts of higher fatty acid esters of low molecular weight alkylol sulfonic acid, e.g., fatty acid esters of the sodium salt of isethionic acid; fatty ethanolamide sulfates; fatty acid amides of amino alkyl sulfonic acids, e.g., lauric acid amide of taurine; alkali metal salts of hydroxy alkane sulfonic acids having 8 to 18 carbon atoms in the alkyl group, e.g., hexadecyl, alphahydroxy sodium sulfonate. Mixtures of these various surfactants are also useful.

It is to be understood that the detailed description of the present invention including the following examples are given merely by way of illustration and that many modifications may be made therein without departing from the spirit and scope of the present invention. In the examples, all percentages are given on a weight basis unless otherwise indicated.

EXAMPLE 1

A large steel maker located in West Germany, produces as much as 35,000 tons per year of mill scale which contains between 3 to 6% adsorbed oil. This oil concentration is too high for the scale to be sintered and in the past it was shipped to another country for disposal at an annual cost in excess of 1.5 million U.S. dollars. This represented a double loss of valuable raw material plus the disposal costs. Multi stage spraying the hot rolled steel with an aqueous spray containing 50 ppm of a compound consisting of nonylphenol with 8 moles of ethylene oxide provides scale which contains less than 1% adsorbed oil and which could be sent directly to the sintering plant. The pressure of its spray at the first stage is 10,000 psi. In the second stage the pressure of the spray is 5,000 psi and in the third stage the pressure is 100 psi. Treatment costs are less than half of the tonnage lost and disposal costs.

EXAMPLE 2

The effectiveness of surfactants when applied from an aqueous solution to prevent adsorption of oily substances on mill scale where the solution is applied prior to the mill product being exposed to an environment containing oily substances was studied in the following laboratory tests.

Samples of oil-laden mill scale was obtained from a commercial steel mill. It was determined that these samples contained about 4½% by weight adsorbed oil.

Portions of the oily mill scale were repeatedly washed with chloroform until all of the adsorbed oil was removed. The resulting de-oiled scale were heated at 100° C. to constant weight and stored in a desiccator until used. The solvent used in the extraction procedure was evaporated to obtain the oil that had been adsorbed on the mill scale.

To a 100 ml centrifuge tube were added 500 mg of de-oiled dried mill scale, 100 ml of tap water and various surfactants. After shaking in a mechanical shaker for 5 minutes, 0.1 ml of the isolated oil was injected into the tube. After the addition of the oily substance, the tube and contents were again shaken, this time for 30 minutes.

The mill scale was separated from the resulting suspension by filtering and then drying for 2 hours at 107° C. The amount of oil on the dried mill scale was determined spectrophotometrically. A blank containing no surfactant was run with each tested surfactant. The percent of the available oil that was prevented from adsorbing on the mill scale by the tested surfactant containing aqueous solutions was determined. In the table below, the composition of the tested solutions and the percentage of oil absorption prevention have been set forth. When the surfactant pretreated mill scale adsorbs as much oil as the untreated mill scale (blank), the surfactant-containing solution is taken as providing 0% protection. When the surfactant pretreated mill scale adsorbs no oil, the surfactant-containing solution is taken as providing 100% protection.

TABLE

| | Composition | Percent Protection |
|---|---|---|
| 1. | 5,000 mg/l of nonylphenol with 4 mols of ethylene oxide | 76 |
| 2. | 5,000 mg/l of nonylphenol with 6 mols of ethylene oxide | 90 |
| 3. | 5,000 mg/l of octylphenol with 10 mols of ethylene oxide | 50 |
| 4. | 1,000 mg/l of octylphenol with 8 mols of ethylene oxide | 76 |
| 5. | 1,000 mg/l of nonylphenol with 7 mols of ethylene oxide | 83 |

What is claimed is:

1. A method of preventing the formation of oily mill scale comprising the steps of:

a. hot rolling steel into a shaped object using a series of carrier and heavy rolls journalled such that lubricant used to reduce the journal friction of the rolls is emitted and deposited onto mill scale resulting from the rolling operation;

b. spraying the rolled steel in multiple stages as the steel moves from one heavy roll to another with a solution consisting essentially of a surfactant in an aqueous carrier, said surfactant being present in an amount sufficient to emulsify the journal lubricant and sprayed with a force sufficient to flake off the mill scale;

c. conveying the sprayed liquid, the emulsified journal lubricant, and the flaked off mill scale together into a container wherein the mill scale settles to the bottom of the container;

d. separating the sprayed liquid into an aqueous phase and an organic phase; and e. recovering the mill scale from the bottom of the container.

2. The process of claim 1 wherein the recovered mill scale is sintered.

3. The process of claim 2 wherein the surfactant is present in the aqueous solution in an amount of about 5 ppm to 5,000 ppm.

4. The process of claim 2 wherein the surfactant is present in the aqueous solution an amount of about 50 ppm to 500 ppm.

5. The method of claim 4 wherein the surfactant is nonionic.

6. The method of claim 4 wherein the surfactant is alkoxylated alkylphenol.

7. The method of claim 6 wherein the surfactant is ethoxylated nonylphenol.

8. The method of claim 7 wherein the number of ethoxy units is about 3–50.

* * * * *